US007026892B2

(12) United States Patent
Kajiya

(10) Patent No.: US 7,026,892 B2
(45) **Date of Patent: *Apr. 11, 2006**

(54) TRANSMISSION LINE PHASE SHIFTER WITH CONTROLLABLE HIGH PERMITTIVITY DIELECTRIC ELEMENT

(75) Inventor: James T. Kajiya, Duvall, WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/961,582

(22) Filed: Oct. 8, 2004

(65) Prior Publication Data

US 2005/0134404 A1 Jun. 23, 2005

Related U.S. Application Data

(63) Continuation of application No. 10/738,684, filed on Dec. 17, 2003.

(51) Int. Cl.
*H01P 1/18* (2006.01)
*H01Q 3/36* (2006.01)

(52) U.S. Cl. ..... 333/161; 342/372; 342/375

(58) Field of Classification Search ..... 333/161, 333/156; 342/372, 375
See application file for complete search history.

(56) References Cited

U.S. PATENT DOCUMENTS 5,406,233 A * 4/1995 Shih et al. ..... 333/161
5,472,935 A * 12/1995 Yandrofski et al. ..... 505/210
5,694,134 A * 12/1997 Barnes ..... 343/700 MS
6,611,230 B1 * 8/2003 Phelan ..... 342/373
6,662,029 B1 * 12/2003 Eden et al. ..... 505/210

* cited by examiner

*Primary Examiner*—Benny Lee
(74) *Attorney, Agent, or Firm*—Christensen, O'Connor, Johnson, Kindness PLLC

(57) ABSTRACT

A transmission line phase shifter ideally suited for use in low-cost, steerable, phased array antennas suitable for use in wireless fidelity (WiFi) and other wireless telecommunication networks, in particular multi-hop ad hoc networks, is disclosed. The transmission line phase shifter includes a wire transmission line, such as a coaxial, stripline, microstrip, or coplanar waveguide (CPW) transmission line. A high-permittivity dielectric element that overlies the signal conductor of the wire transmission line is used to control phase shifting. Phase shifting can be electromechanically controlled by controlling the space between the high-permittivity dielectric element and the signal conductor of the wire transmission line or by electrically controlling the permittivity of the high-permittivity dielectric element.

12 Claims, 16 Drawing Sheets

TRANSMISSION LINE PHASE SHIFTER WITH CONTROLLABLE HIGH PERMITTIVITY DIELECTRIC ELEMENT

CROSS-REFERENCE TO RELATED APPLICATION

This application is a continuation of application Ser. No. 10/738,684, filed Dec. 17, 2003, priority from the filing date of which is hereby claimed under 35 U.S.C. § 120.

FIELD OF THE INVENTION

This invention relates to phase shifters, and more particularly to phase shifting transmission lines.

BACKGROUND OF THE INVENTION

As will be better understood, the present invention is directed to transmission line phase shifters that are ideally suited for use in low-cost, steerable, phased array antennas. While ideally suited for use in low-cost, steerable, phased array antennas, and described in combination with such antennas, it is to be understood that transmission line phase shifters formed in accordance with this invention may also find use in other environments.

Antennas generally fall into two classes—omnidirectional antennas and steerable antennas. Omnidirectional antennas transmit and receive signals omnidirectionally, i.e., transmit signals to and receive signals from all directions. A single dipole antenna is an example of an omnidirectional antenna. While omnidirectional antennas are inexpensive and widely used in environments where the direction of signal transmission and/or reception is unknown or varies (due, for example, to the need to receive signals from and/or transmit signals to multiple locations), omnidirectional antennas have a significant disadvantage. Because of their omnidirectional nature, the power signal requirements of omnidirectional antennas are relatively high. Transmission power requirements are high because transmitted signals are transmitted omnidirectionally, rather than toward a specific location. Because signal reception is omnidirectional, the power requirements of the transmitting signal source must be relatively high in order for the signal to be detected.

Steerable antennas overcome the power requirement problems of omnidirectional antennas. However, in the past, steerable antennas have been expensive. More specifically, steerable antennas are "pointed" toward the source of a signal being received or the location of the receiver of a signal being transmitted. Steerable antennas generally fall into two categories, mechanically steerable antennas and electronically steerable antennas. Mechanically steerable antennas use a mechanical system to steer an antenna structure. Most antenna structures steered by mechanical systems include a parabolic reflector element and a transmit and/or receive element located at the focal point of the parabola. Electronically steerable antennas employ a plurality of antenna elements and are "steered" by controlling the phase of the signals transmitted and/or received by the antenna elements. Electronically steerable antennas are commonly referred to as phased array antennas. If the plurality of antenna elements lie along a line, the antenna is referred to as a linear phased array antenna.

While phased array antennas have become widely used in many environments, particularly high value military, aerospace, and cellular phone environments, in the past phased array antennas have had one major disadvantage. They have been costly to manufacture. The high manufacturing cost has primarily been due to the need for a large number of variable time delay elements, also known as phase shifters, in the antenna element feed paths. In the past, the time delay or phase shift created by each element has been independently controlled according to some predictable schedule. In general, independent time delay or phase shift control requires the precision control of the capacitance and/or inductance of a resonant circuit. While mechanical devices can be used to control capacitance and inductance, most contemporary time delay or phase shifting circuits employ an electronic controllable device, such as a varactor to control the time delay or phase shift produced by the circuit. While the cost of phased array antennas can be reduced by sector pointing and switching phased array antennas, the pointing capability of such antennas is relatively coarse. Sector pointing and switching phased array antennas frequently use microwave switching techniques employing pin diodes to switch between phase delays to create switching between sectors. Because sector pointing and switching phased array antennas point at sectors rather than at precise locations, like omnidirectional antennas, they require higher power signals than location pointing phased array antennas.

Because of their expense, in the past, phased array antennas have not been employed in low-cost wireless network environments. For example, phased array antennas in the past have not been used in wireless fidelity (WiFi) networks. As a result, the significant advantages of phased array antennas have not been available in low-cost wireless network environments. Consequently, a need exists for a low-cost, steerable, phased array antenna having the ability to be relatively precisely pointed. This invention is directed to providing a transmission line phase shifter ideally suited for use in low-cost, steerable, phased array antennas.

SUMMARY OF THE INVENTION

The present invention is directed to transmission line phase shifters ideally suited for use in low-cost, steerable, phased array antenna suitable for use in wireless fidelity (WiFi) and other wireless communication network environments. Antennas employing the invention are ideally suited for use in multi-hop ad hoc wireless signal transmission networks.

A transmission line phase shifter formed in accordance with the invention is implemented as a wire transmission line positioned and sized so as to allow the permittivity of a high-permittivity dielectric element to control phase shifting.

In accordance with further aspects of this invention, phase shifting is electromechanically controlled by controlling the space between the high-permittivity dielectric element and the wire transmission line.

In accordance with other further aspects of this invention, the high-permittivity dielectric element has a planar shape and phase shifting is controlled by moving the plane of the element toward and away from the wire transmission line.

In accordance with alternative aspects of this invention, the high-permittivity dielectric element is in the form of a cylinder having an axis of rotation that is offset from the axis of the cylinder. Phase shifting is controlled by rotating the cylindrical element such that the space between the element and the wire transmission line changes.

In accordance with other alternative aspects of the invention, phase shifting is electronically controlled by electrically controlling the permittivity of the high-permittivity dielectric element.

In accordance with yet further aspects of this invention, the wire transmission line is implemented in printed circuit board form.

In accordance with yet still other aspects of this invention, the wire transmission line is printed on a sheet of dielectric material using conventional printed circuit board techniques.

As will be readily appreciated from the foregoing summary, the invention provides a low-cost transmission line phase shifter. The transmission line phase shifter is low cost because a common high-permittivity dielectric element is employed to control phase shift. Time delay (phase shift) control is provided by electromechanically controlling the interaction of the permittivity of the high-permittivity dielectric element on a wire transmission line. The permittivity interaction is controlled by controlling the position of the high-permittivity dielectric element with respect to the wire transmission line using?? a low-cost electromechanical device, such as a low-cost servo-controlled motor, a voice coil motor, etc., or by electrically controlling the permittivity of the high-permittivity dielectric element. Phased array antennas employing the invention are also low cost because such antennas are ideally suited for implementation in low-cost printed circuit board form.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings where like reference numerals in different drawings refer to like elements throughout the drawings and, wherein.

DETAILED DESCRIPTION OF THE PREFERRED EMBODIMENT

As will be better understood from the following description, the corporate feed of a phased array antenna embodying this invention employs transmission line phase shifters. More specifically, phased array antenna elements typically receive signals to be transmitted from, and apply received signals to, microwave feeds. Typical microwave feeds include coaxial, stripline, microstrip, and coplanar waveguide (CPW) transmission lines. The propagation of signal waves down such transmission lines can be characterized by an effective permittivity that summarizes the detailed electromagnetic phenomenon created by such propagation. In this regard, the velocity of propagation (c) of a signal along a parallel wire transmission line is given by:

$$c = \frac{1}{\sqrt{\varepsilon\mu}} \tag{1}$$

where $\in$ is the relative permittivity and $\mu$ is the relative permeability of the dielectric materials in the region between the wires of the transmission line. Since all practical dielectrics have a $\mu$ of approximately 1, it is readily apparent that the velocity of propagation is proportional to the inverse square root of the permittivity value, i.e., the inverse square root of $\in$.

Figures 1, 2:
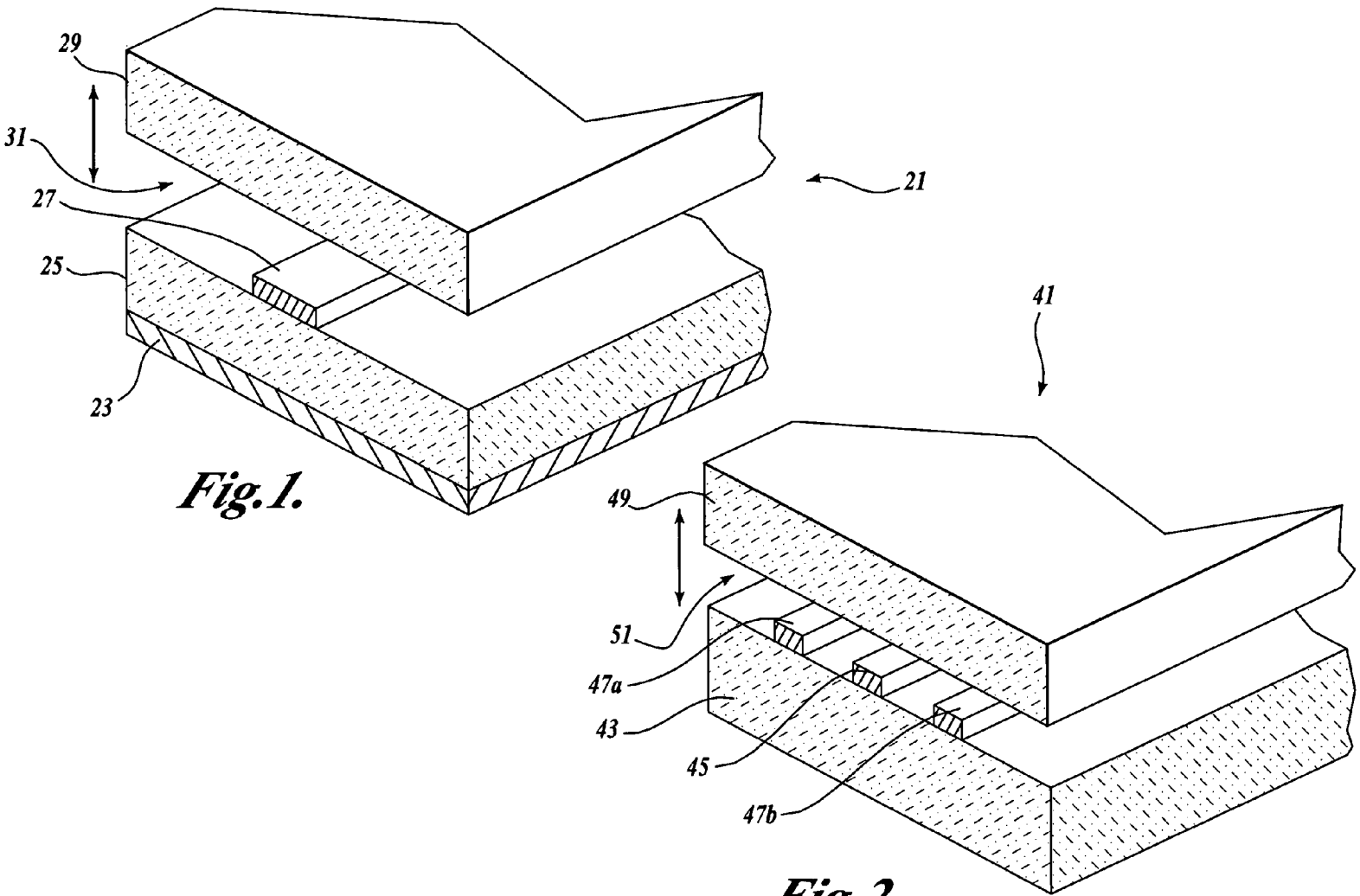
FIG. 1 is a partial isometric view of a microstrip transmission line.
FIG. 2 is a partial isometric view of a coplanar waveguide transmission line.

FIGS. 1 and 2 are partial isometric views that illustrate two types of microwave feed transmission lines—microstrip and CPW transmission lines, respectively. Both types of wire transmission lines have an effective permittivity given by complex formulas that can be developed by experimental or numerical simulations. Because approximate formulas can be found in many textbooks and papers and are not needed to understand the present invention, such formulas are not reproduced here. It is, however, important to understand that the effective permittivity of a wire transmission line depends on the thickness and permittivity values of the different dielectric layers included in the structure of the transmission line. It is also important to understand that varying the parameters of the different dielectric layers can be used to vary the velocity of transmission line signal propagation and, thus, used to shift the phase of signals propagating along the transmission line. Control of signal velocity controls signal time delay and, thus, controls phase shift.

As noted above, FIG. 1 illustrates a microstrip transmission line 21. The illustrated microstrip transmission line 21 comprises a ground plane 23 formed of a conductive material, a first dielectric layer 25, a signal conductor 27 also formed of a conductive material, and a second dielectric layer 29. The ground plane 23 is located on one surface of the first dielectric layer 25, and the signal conductor 27 is located on the other surface of the first dielectric layer 25. The first dielectric layer 25 may be a conventional dielectric sheet of the type used to create printed circuit boards (PCBs) and the ground plane 23 and signal conductor 27 printed circuits located on opposite surfaces of the dielectric sheet. The second dielectric layer 29 is spaced from the surface of the first dielectric layer containing the signal conductor 27. The effective permittivity of the microstrip transmission line illustrated in FIG. 1 depends on the thickness and permittivity values of the first and second dielectric layers 25 and 29 and by the air gap 31 between the first and second dielectric layers, since air is also a dielectric.

The coplanar wave guide (CPW) transmission line 41 illustrated in FIG. 2 comprises a first dielectric layer 43, a signal conductor 45, two ground conductors 47*a* and 47*b*, and a second dielectric layer 49. The signal conductor 45 and the ground conductors 47*a* and 47*b* are located on one surface of the first dielectric layer 43. The first and second ground conductors 47*a* and 47*b* lie on opposite sides of, and run parallel to, the signal conductor 45. The spacing between the signal conductor and each of the ground conductors is the same, i.e., the ground conductors are equally spaced from the signal conductor. The first dielectric layer 43, the signal conductor 45 and the first and second ground conductors 47*a* and 47*b* may take the form of a printed circuit board wherein the conductors are deposited on one surface of a dielectric sheet using conventional printed circuit board manufacturing techniques. The second dielectric layer 49 is spaced from the surface of the first dielectric layer 43 that contains the signal conductor 45 and the first and second ground conductors 47*a* and 47*b*. As with the microstrip transmission line illustrated in FIG. 1, the effective permittivity of the CPW transmission line illustrated in FIG. 2 is dependent on the thickness and permittivity values of the first and second dielectric layers 43 and 49 and the air gap 51 between the first and second dielectric layers.

As will be better understood from the following description, the invention is based on the understanding that the velocity of a signal propagating along a microwave feed type of wire transmission line, such as the microstrip and CPW transmission lines illustrated in FIGS. 1 and 2, is dependent on the effective permittivity of the transmission line. Because the velocity of signal propagation is determined by the effective permittivity of a wire transmission line, the time delay and, thus, the phase shift created by a transmission line can be controlled by controlling the effective permittivity of the transmission line. Further, several embodiments of the invention are based on the understanding that the effective permittivity of a wire transmission line can be controlled by controlling the thickness of the air gap defined by a pair of dielectric layers through which the signal conductor of the microwave feed transmission line passes. More specifically, these embodiments of the invention are based on controlling the thickness of the air layer immediately above the transmission line wire, i.e., the signal conductor. While either the first or second dielectric layer could be moved with respect to the other dielectric layer, preferably the second dielectric layer is moved with respect to the first dielectric layer, the first dielectric layer remaining stationary. Also, preferably, the second dielectric layer is formed of a low-cost, high-permittivity material, such as Rutile (Titanium Dioxide or $TiO_2$), or compounds of Rutile containing alkali earth metals such as Barium or Strontium.

An alternative to mechanically controlling the thickness of the air gap between the first and second dielectric layers in order to control time delay and, thus, phase shift is to control the permittivity of the second dielectric layer and leave the thickness of the air gap constant. The permittivity of ferroelectric materials varies under the influence of an electric field. Rutile and Rutile compounds that contain alkalite earth metals such as Barium or Strontium exhibit ferroelectric properties.

As will be readily appreciated by those skilled in the art and others from FIGS. 1 and 2 and the foregoing description, transmission line phase shifters differ from conventional phase shifters in that they are distributed phase shifters, i.e., they include no lumped elements. As a result, no separate electrical components are needed to create transmission line phase shifters. Since there are no limitations on the physical size of transmission line phase shifters, such phase shifters can be used for high-power, low-frequency applications.

Phased array antennas are based on a simple principle of operation; the transmission or reception angle, i.e., the Bragg angle θ, of a linear phased array antenna is determined by the spacing, a, between the elements of the antenna array, the wavelength of the applied wave and the phase of the applied wave at each antenna element. More specifically, $$\sin\theta = \frac{\Delta c}{a} = \frac{\phi\lambda}{2\pi} \tag{2}$$

where a equals the spacing between the elements of the antenna array, c equals the frequency (γ) divided by the wavelength (λ), Δ equals the time delay, ϕ equals the phase delay. Each antenna element (n) receives the wave at a time delay of:

$$n\Delta = \frac{na}{c}\sin\theta \tag{3}$$

Advancing the signals from each antenna element by the equation (3) amount results in the signals interfering in a constructive manner and gain being achieved.

Figure 3:
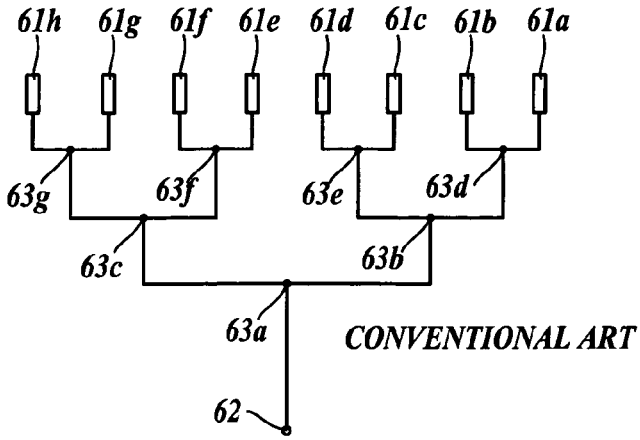
FIG. 3 is a pictorial view of a corporate feed for an eight element phased array antenna.

As will be better understood from the following description, phased array antennas employing transmission line phase shifters of the type described above include such phase shifters in the branches of a corporate feed connected to the antenna elements of a phased array antenna. FIG. 3 illustrates a conventional corporate feed, connected to the elements 61*a*–61*h* of an eight-element phased array antenna. A conventional corporate feed is a tree-shaped arrangement having transformers placed at each of the vertices where the tree branches. The transformers are impedance matching transformers that match the impedances of the branches that join at the vertices. Impedance matching is customarily accomplished with transmission line resonant transformers. The signal input/output terminal 62 of the corporate feed illustrated in FIG. 3 terminates at a first level vertice 63*a* that splits into two branches each of which ends at a second level vertice 63*b*, 63*c*. The second level vertices 63*b*, 63*c*, in turn, each split into branches that end at a third level vertice 63*d*–63*g*. The third level vertices split into branches that end at the antenna elements 61*a*–61*h*.

Figure 4:
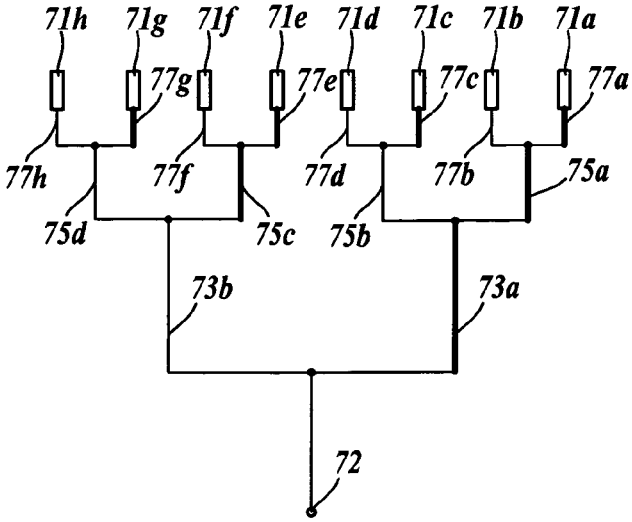
FIG. 4 is a corporate feed of the type illustrated in FIG. 3, including transmission line phase shift branches sized and positioned in accordance with the invention.

Phased array antennas embodying the present invention recognize that a phased array antenna can be steered by appropriately phase shifting the signals applied to the branches on one side of a corporate tree. Such an arrangement is illustrated in FIG. 4. More specifically, FIG. 4 illustrates a phased array antenna comprising eight elements 71*a*–71*h* fed by a corporate feed similar to the corporate feed illustrated in FIG. 3, except the right-hand side of every branch of the corporate feed tree includes a transmission line phase shifter. More specifically, the right-hand side 73*a* of the first branch of the corporate feed tree includes a transmission line phase shifter and the left side branch 73*b* does not include a phase shifter. The right side branches of 75*a* and 75*c* of the next level of the corporate feed tree also include transmission line phase shifters, whereas the left side branches 75*b* and 75*d* do not include phase shifters. Likewise, the right side branches 77*a*, 77*c*, 77*e*, 77*g* of the next (final) level of the corporate feed tree include transmission line phase shifters, whereas the left side branches 77*b*, 77*d*, 77*f*, and 77*h* do not include phase shifters.

As illustrated by different line lengths in FIG. 4, the amount of phase shift is different in each level branch. If the amount of phase shift that occurs in first level right side branch 73*a* is expressed as Δ, the phase shift of the right side branches 75*a* and 75*c* of the second level is Δ/2, and the phase shift of the right side branches 77*a*, 77*c*, 77*e*, and 77*g* of the third level is Δ/4. If additional branches were included, the delay of the right side branches of the next level would be Δ/8, etc. Thus, each antenna element 71*a*–71*h* receives a uniform delay increment over its neighbor. In the case of an eight element linear array, if the leftmost element 71*h* has a 0 delay, the next element 71*g* has a delay of Δ/4, the next element 71*f* has a delay of Δ/2, the next element 71*e* has a delay of 3Δ/4, the next element 71*d* has a delay of Δ, the next element 71*c* has a delay of 5Δ/4, the next element 71*b* has a delay of 3Δ/2, and the final element 71*c* has a delay of 7Δ/4. Since each antenna receives a uniform delay increment over its neighbor, the antenna array is steered to the left by the Bragg angle θ.

As pictorially illustrated in FIG. 4, the foregoing phase shift scheme is easily effected by halving the length of the transmission line, forming the phase shifting branches of the levels of the corporate tree proceeding from the lower branch levels to the upper branch levels. A feature of this arrangement is that all of the phase shifting side (right) branches of the corporate feed tree can be "ganged" together so that a single mechanism can be used to simultaneously control the effective permittivity of all of the phase shifting side branches. Thus, only a single mechanical spacing control device, or a single value of electric field, is required to steer a phased array antenna incorporating a corporate feed of the type illustrated in FIG. 4. It is to be understood that while FIG. 4 depicts a corporate feed wherein the right side branches of the various levels of the corporate feed all include transmission line phase shifters, the same effect can be achieved by placing transmission line phase shifters instead in the left side branches.

Figure 5:
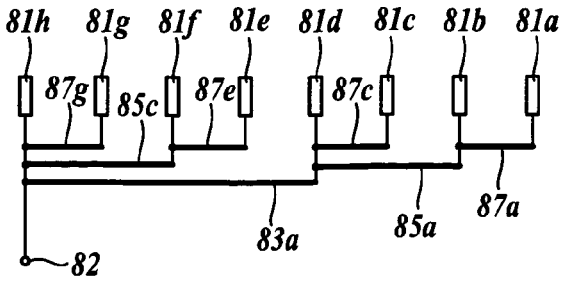
FIG. 5 is a reorientation of the corporate feed illustrated in FIG. 4 in accordance with the invention.

While a single control system can be developed to control the phase shifting of the phase shifting branches of a corporate feed of the type illustrated in FIG. 4, in accordance with the invention, the complexity and size of such a control system can be reduced by changing the geometry of the corporate feed in the manner illustrated in FIG. 5. FIG. 5 illustrates an arrangement wherein all of phase shifting side branches of a corporate feed are closely packed in a single area. More specifically, FIG. 5 illustrates a corporate feed wherein the input/output terminal 82 of the corporate feed is connected to a first phase shift transmission line 83*a* that performs the function of the right side branch 73*a* of the first level of the corporate feed shown in FIG. 4. The first phase transmission line 83*a* is connected to a second phase shift transmission line 85*a* that, in turn, is connected to a third phase shift transmission line 87*a*. The second and third phase shift transmission lines 85*a* and 87*a* perform the functions of the rightmost side branches 75*a* and 77*a* of the next two levels of the corporate feed shown in FIG. 4. The third phase shift transmission line 87*a* is connected to the first antenna element 81*a*.

In addition to being connected to the third phase shift transmission line 87*a*, the second phase shift transmission line 85*a* is connected to the second antenna element 81*b*. In addition to being connected to the second phase shift transmission line 85*a*, the first phase shift transmission line 83*a* is connected to a fourth phase shift transmission line 87*c*. The fourth phase shift transmission line 87*c* performs the function of right side branch 77*c* of the corporate feed shown in FIG. 4. The fourth phase shift transmission line 87*c* is connected to the third antenna element 81*c*. The first phase shift transmission line 85*a* is also connected to the fourth antenna element 81*d*.

The input/output terminal 82 is also connected to a fifth phase shift transmission line 85*c*. The fifth phase shift transmission line 85*c* performs the function of right side branch 75*c* of the corporate feed shown in FIG. 4. The fifth phase shift transmission line 85*c* is connected to a sixth phase shift transmission line 87*e*. The sixth phase shift transmission line 87*e* performs the function of the right side branch 77*e* of the corporate feed shown in FIG. 4. The sixth phase shift transmission line 87*e* is connected to the fifth antenna element 81*e*. The fifth phase shift transmission line 85*c* is also connected to the sixth antenna element 81*f*.

The input/output terminal is also connected to a seventh phase shift transmission line 87*g*. The seventh phase shift transmission line 87*g* performs the function of the right side branch 77*g* of the corporate feed shown in FIG. 4. The seventh phase shift transmission line 87*g* is connected to the seventh antenna element 81*g*. The input/output terminal 82 is also directly connected to the eighth antenna element 81*h*.

The length of the third, fourth, sixth, and seventh phase shift transmission lines 87*a*, 87*c*, 87*e*, and 87*g* is equal to one-half the length of the second and fifth phase shift transmission lines 85*a* and 85*c*. Further, the length of the second and fifth phase shift transmission lines 85*a* and 85*c* is equal to one-half the length of the first phase shift transmission line 83*a*. Further, the third, fourth, sixth, and seventh phase shift transmission lines 87*a*, 87*c*, 87*e*, and 87*g*, while spaced apart, are coaxial, as are the second and fifth phase shift transmission lines 85*a* and 85*c*. Finally, the axis of the third, fourth, sixth, and seventh phase shift transmission lines 87*a*, 87*c*, 87*e*, and 87*g*, the axis of the second and fifth phase shift transmission lines 85*a* and 85*c* and the axis of the first phase shift transmission line 83A all lie parallel to one another and close together.

A comparison of FIGS. 4 and 5 reveals that the line delays or phase shift amounts applied to the signals applied to or received by each of the antenna elements is the same in both figures, the difference being that the geometry of the corporate feed in FIG. 5 is more closely packed into a single area than is the geometry of the corporate feed illustrated in FIG. 4. As will be better understood from the following description of phased array antennas embodying transmission line phase shifters formed in accordance with the invention, closely packing phase shift transmission lines into a single area allows a smaller high-permittivity element to be used to simultaneously control the phase shifting of each of the phase shift transmission lines. More specifically, as will be better understood from the following description, this arrangement allows a high-permittivity dielectric rectangular plate or cylinder whose position is controlled by a suitable electromechanical device, to be used to control the phase shift produced by the phase shift transmission lines. Alternatively, a permittivity controllable element can be used.

FIGS. 6–22 illustrate several embodiments of a low-cost, steerable, phased array antenna embodying transmission line phase shifters formed in accordance with the present invention based on the previously discussed phase shift concepts. While the phased array antennas illustrated in FIGS. 6–22 and described herein are all linear phased array antennas, it is to be understood that other antenna element arrays can be used in combination with corporate feeds of the type described herein to create other versions. Hence, it is to be understood that phased array antennas embodying transmission line phase shifters formed in accordance with the invention are not limited to the embodiments that are hereinafter described in detail.

Figure 6:
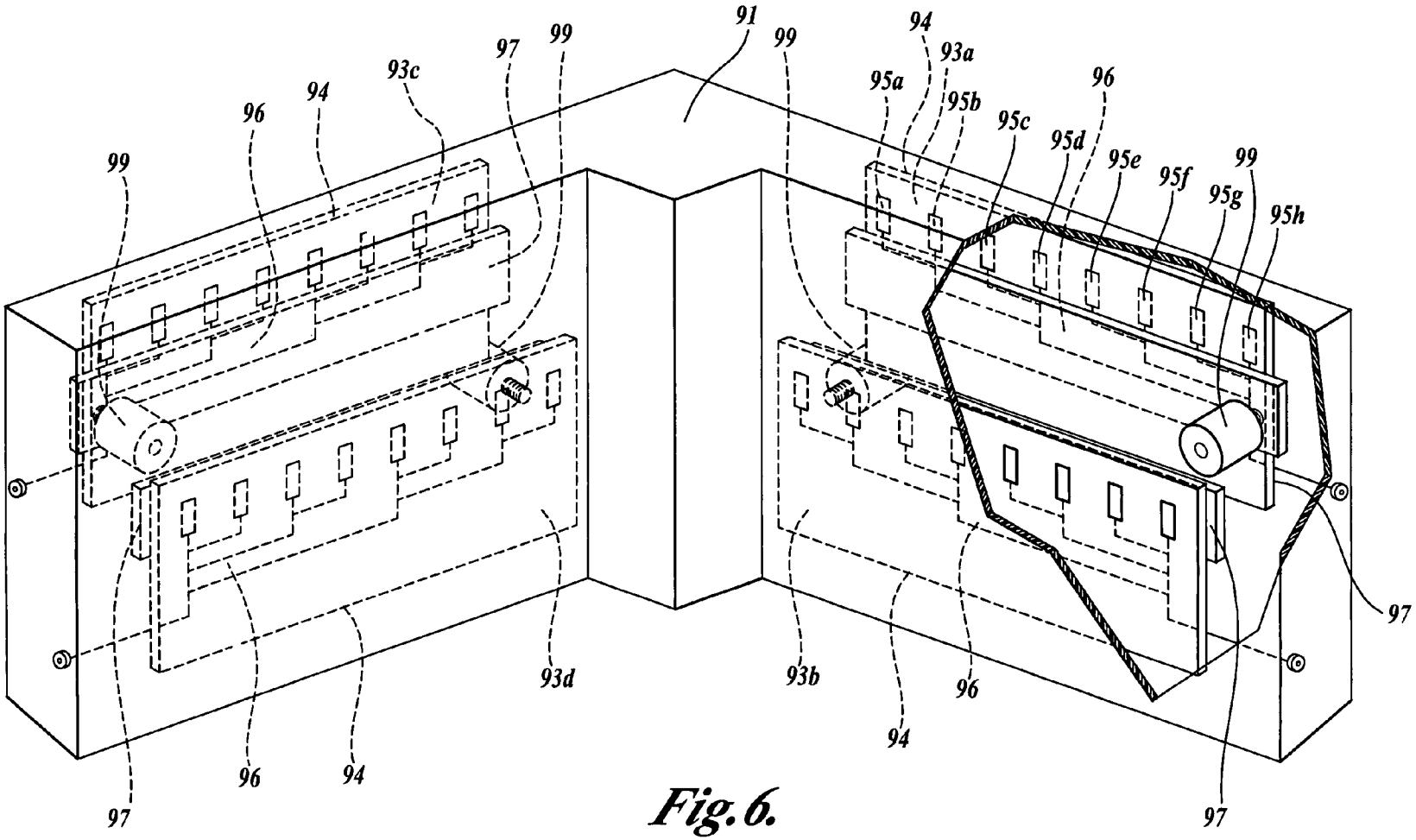
FIG. 6 is an isometric view, partially in section, of a first embodiment of a low-cost, steerable, phased array antenna formed in accordance with the invention.
Figure 7:
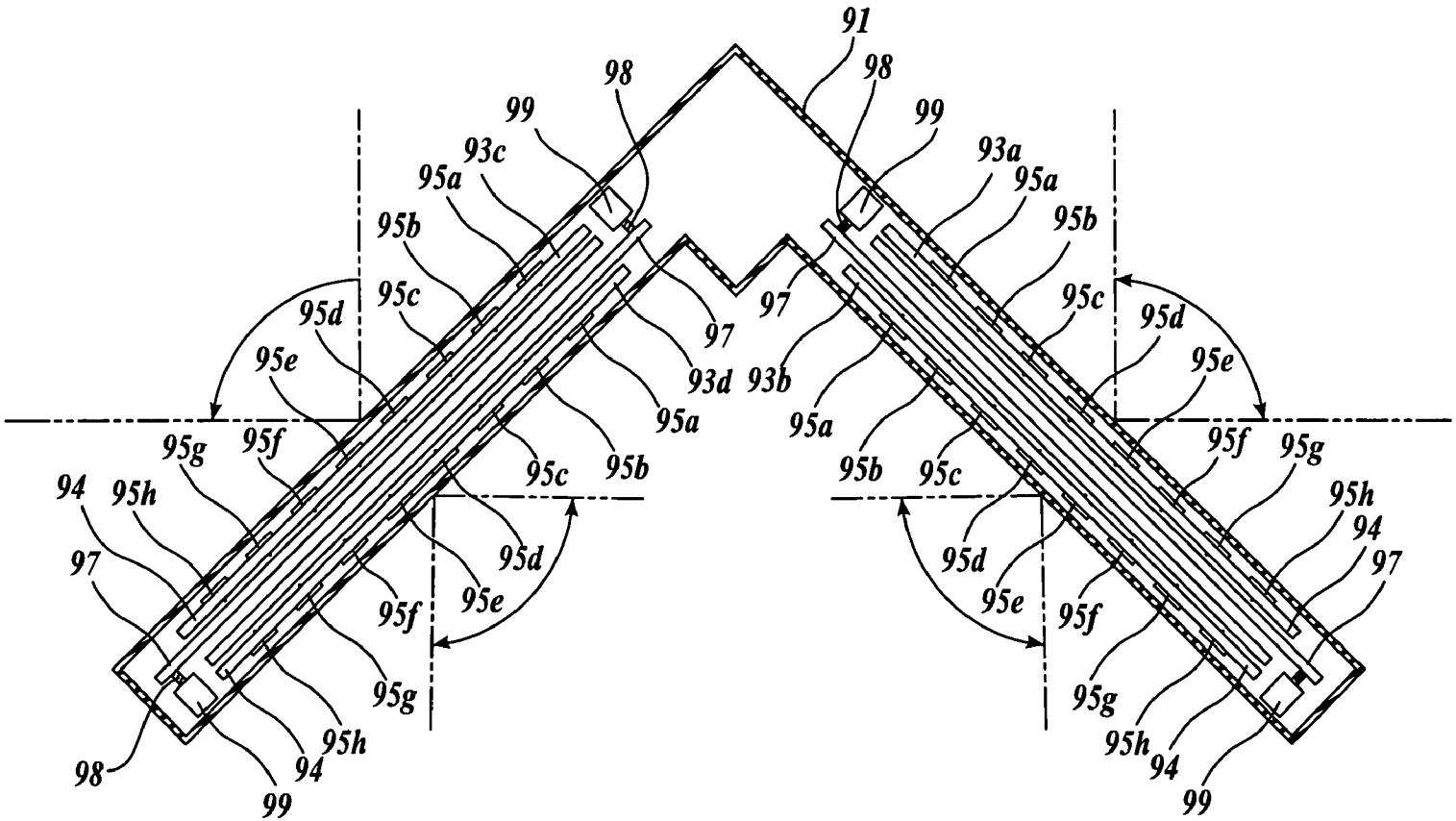
FIG. 7 is a top cross-sectional view of FIG. 6.
Figure 8:
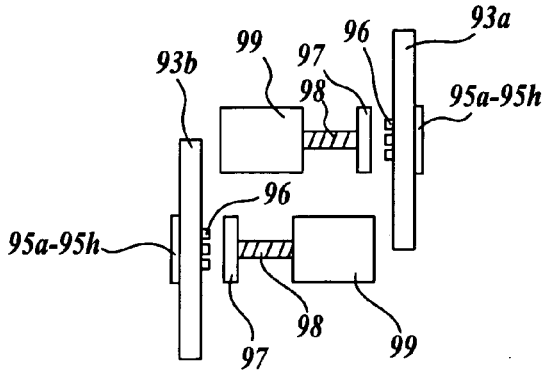
FIG. 8 is an end elevational view of a portion of the phased array antenna illustrated in FIG. 6.

FIGS. 6–8 illustrate a first embodiment of a 360° phased array antenna assembly embodying transmission line phase shifters formed in accordance with the present invention. The phased array antenna assembly includes an L-shaped housing 91. Located in each leg of the L-shaped housing are two back-to-back phased array antennas 93*a*, 93*b*, 93*c*, and 93*d*, each comprising eight linearly arrayed antenna elements and a corporate feed of the type illustrated in FIG. 5 and described above. More specifically, each of the phased array antennas includes a sheet of dielectric material 94, such as a printed circuit board (PCB) sheet. One of the PCB sheets 94 lies adjacent each of the four outer faces of the L-shaped housing 91. The outer surface of each of the PCB sheets includes a linear array of antenna elements, eight in the illustrated embodiment of the invention 95*a*–95*h*. Located on the inner surface of each of the PCB sheets 94 is a corporate feed 96 having the geometric layout illustrated in FIG. 5 and described above. Overlying each of the corporate feeds 96 is a high dielectric layer 97, i.e., a dielectric layer formed of a high-permittivity material. A suitable low-cost, high-permittivity material is Rutile (Titanium Dioxide, or $TiO_2$) or a Rutile compound containing alkali earth metals such as Barium or Strontium. The high-permittivity dielectric layer may be supported by another dielectric sheet or layer or, if sufficiently strong, may be self-supporting. In any event, each of the high-permittivity dielectric layers 97 is mounted and supported such that the gap between the layer and the underlying corporate feed is controllable by a suitable electromechanical positioning means such as an electric motor 99 operating a jack screw mechanism 98. The electric motor can be an AC or DC motor, servomotor, or any other suitable motor. Alternatively, the position of the high-permittivity layer can be controlled by a voice coil motor. For ease of illustration, support mechanisms for supporting the PCB sheets 94, the high-permittivity dielectric layers, and the electric motors 99 are not illustrated in FIGS. 6–8.

As will be readily appreciated from the foregoing description, controlling the position of the high-permittivity dielectric layers 97 controls the air gap between the layers and the phase shift transmission lines of the corporate feed, thereby steering, i.e., controlling, the pointing of the linear array of antenna elements 93*a*–93*h*. As shown by the arcs in FIG. 7, each of the phased array antennas 93*a*, 93*b*, 93*c*, and 93*d* points in a different direction. Preferably, each of the antennas covers an arc of 90°, i.e., a quadrant. As illustrated in FIG. 7, when the quadrants are combined, the quadrants do not overlap and the antenna assembly illustrated in FIGS. 6–8 covers 360°. As a result, the antenna assembly can be "pointed" in any direction by controlling which antenna is employed and the pointing of that antenna, as described below with respect to FIG. 23.

Figure 11:
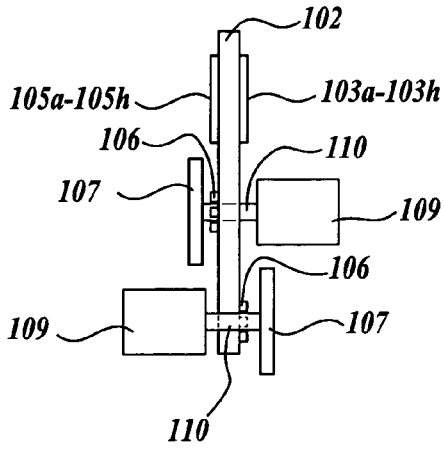
FIG. 11 is an end elevational view of a portion of the phased array antenna illustrated in FIG. 9.
Figure 9:
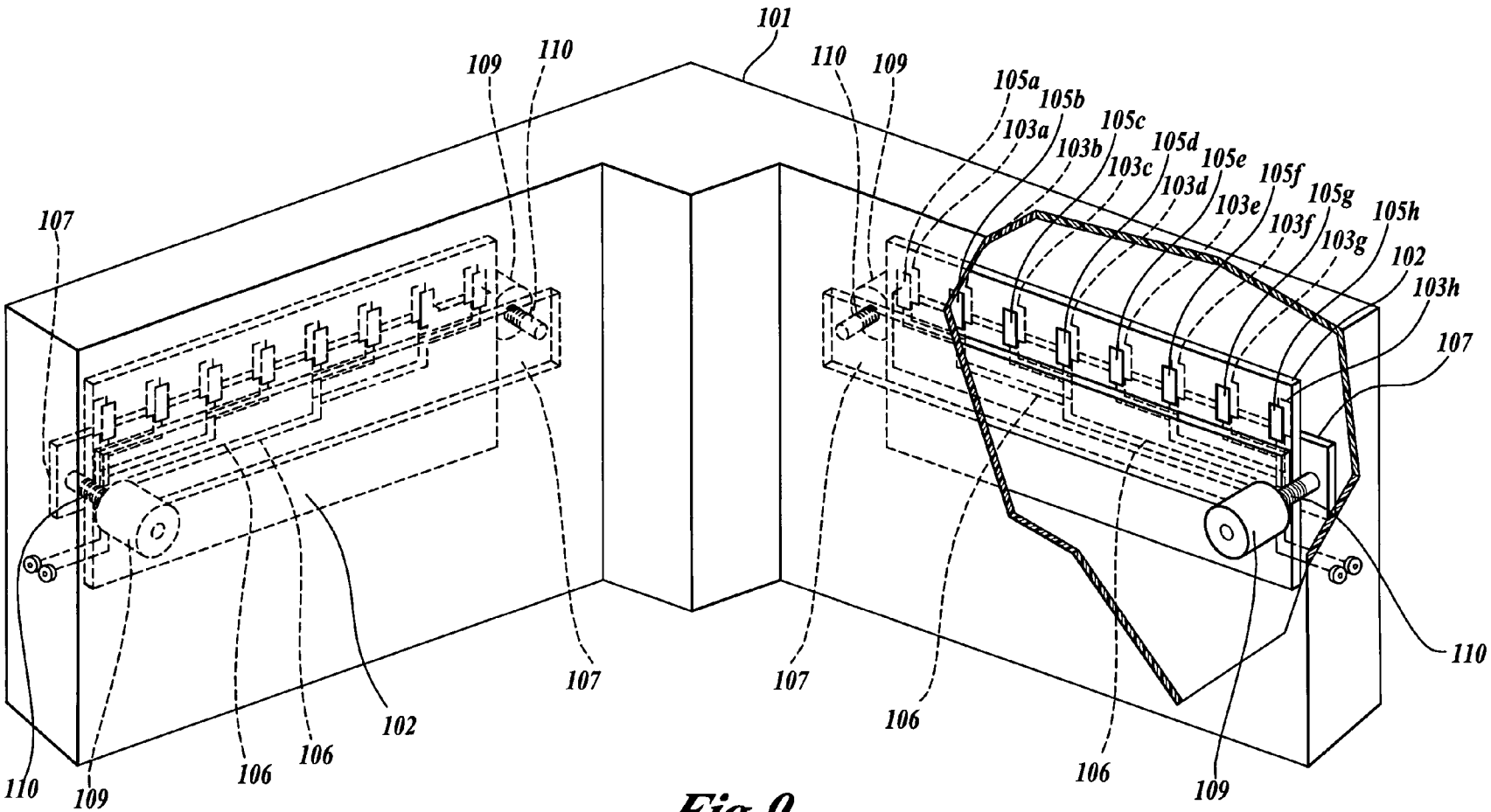
FIG. 9 is an isometric view, partially in section, of a second embodiment of a low-cost, steerable, phased array antenna formed in accordance with the invention.
Figure 10:
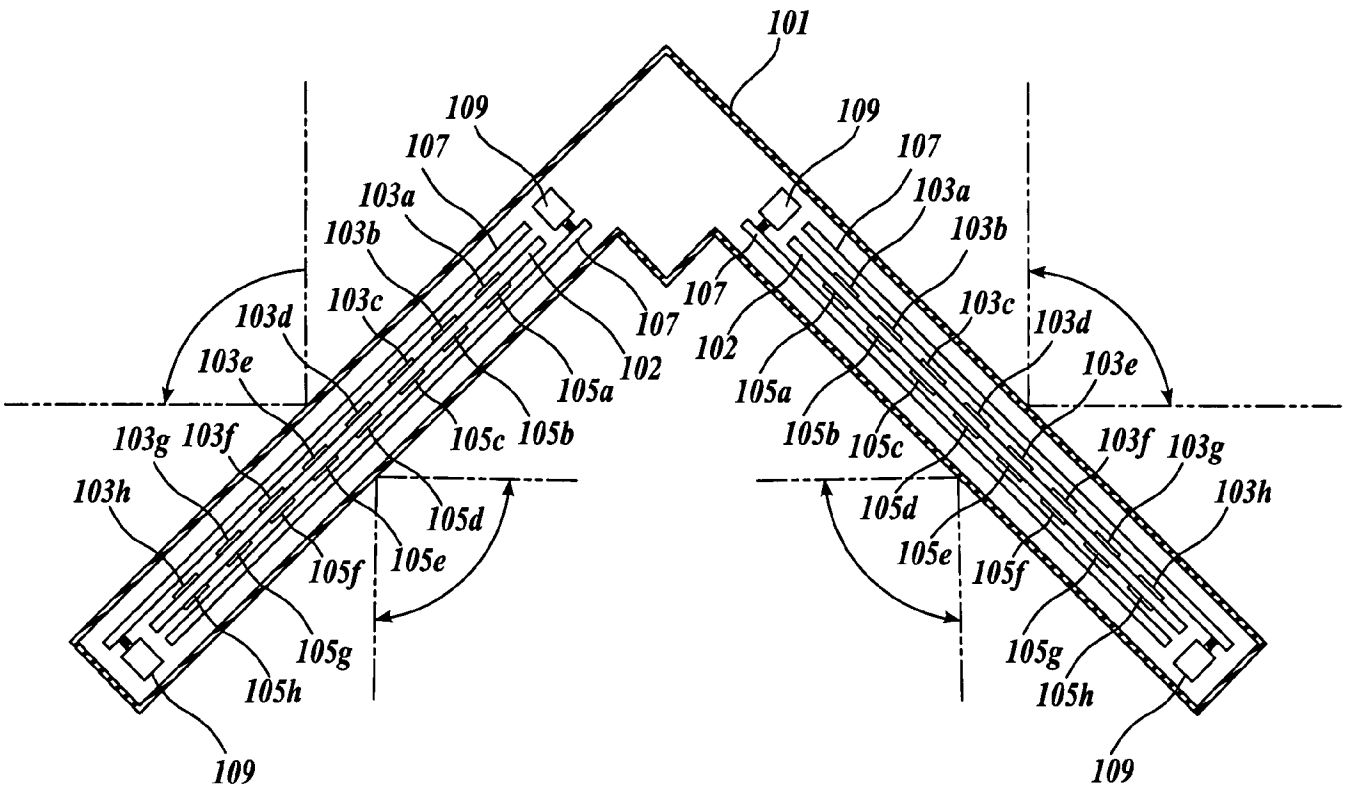
FIG. 10 is a top cross-sectional view of FIG. 9.

FIGS. 9–11 illustrate a second embodiment of a low-cost, steerable, phased array antenna assembly embodying transmission line phase shifters formed in accordance with the invention that is somewhat similar to, but different from, the antenna assembly illustrated in FIGS. 6–8. Like the antenna assembly illustrated in FIGS. 6–8, the antenna assembly illustrated in FIGS. 9–11 includes an L-shaped housing 101. Each leg of the housing includes two linear phased array antennas pointing in opposite directions. However, rather than the phased array antennas being mounted on the outer facing side of a different PCB sheet and the corporate feed mounted on the inner facing side of the same PCB sheet, the antenna assembly illustrated in FIGS. 9–11 includes a single PCB sheet 102 in each of the legs, mounted such that both surfaces face outwardly. The elements 103*c*–103*h* of one of the linear phase array antennas are located on one face of the PCB sheet 102, and the elements 105*a*–105*h* of the other phased array antenna are located on the other facing of the PCB sheet. Further, the corporate feeds 106 of the related antennas are located on the same side of the PCB sheet 102 as their related antenna elements. In addition, rather than high-permittivity dielectric layers being located inboard or between the PCB sheets supporting the antenna elements, as in the FIGS. 6–8 antenna assembly, the high-permittivity dielectric layers 107 of the FIGS. 9–11 antenna assembly are located outboard of the PCB sheets 102 that support the antenna elements and the corporate feeds. As before, the high-permittivity dielectric layers 107 overlie or are aligned with the corporate feeds 106 of their respective antennas. Further, suitable electromechanical movement mechanisms, such as electric motors 109 having threaded shafts for interacting with threaded receiving elements, i.e., jack screws 110, are used to position the high-permittivity dielectric layers 107 with respect to the phase shift transmission lines of the corporate feed 106 that each layer overlies to thereby control the air gap between the high-permittivity dielectric layer and the phase shift transmission lines of the corporate feed.

Figure 12:
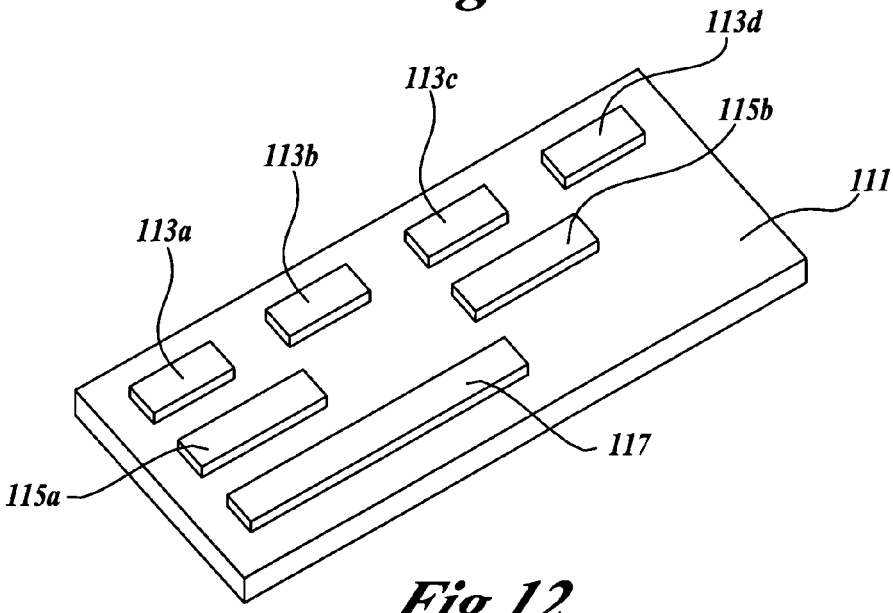
FIG. 12 is an isometric view of an alternative embodiment of a planar dielectric element suitable for use in the embodiments of the invention illustrated in FIGS. 6–8 and 9–11.

While, as noted above, the high-permittivity dielectric layers included in the low-cost, steerable, phased array antenna assemblies illustrated in FIGS. 6–8 and 9–11 may be single dielectric sheets or layers formed of a high-permittivity material that is self-supporting or mounted on a supporting sheet that is also formed of a dielectric material, alternatively, as illustrated in FIG. 12, the high-permittivity dielectric layers may be formed by a plurality of low-cost, high-permittivity dielectric sections or slugs 113*a*–112*d*, 115–115*b*, and 117 mounted on one surface of a supporting sheet also formed of a dielectric material. The high-permittivity dielectric slugs are preferably rectangularly shaped. Regardless of shape, the high-permittivity dielectric slugs 113*d*, 115*a*, 115*b*, and 117 are sized and positioned on the substrate 11 so as to be alignable with and overlie the respective phase shift transmission lines of the corporate feed. In this regard, as clearly illustrated in FIG. 12, the high-permittivity dielectric slugs include four relatively short slugs 113*a*–113*d*, two intermediate length slugs 115*a* and 115*b*, and one long slug 117, each respectively equal in length to the short, intermediate, and long phase shift transmission lines of the corporate feed illustrated in FIG. 5 and described above.

Figure 13:
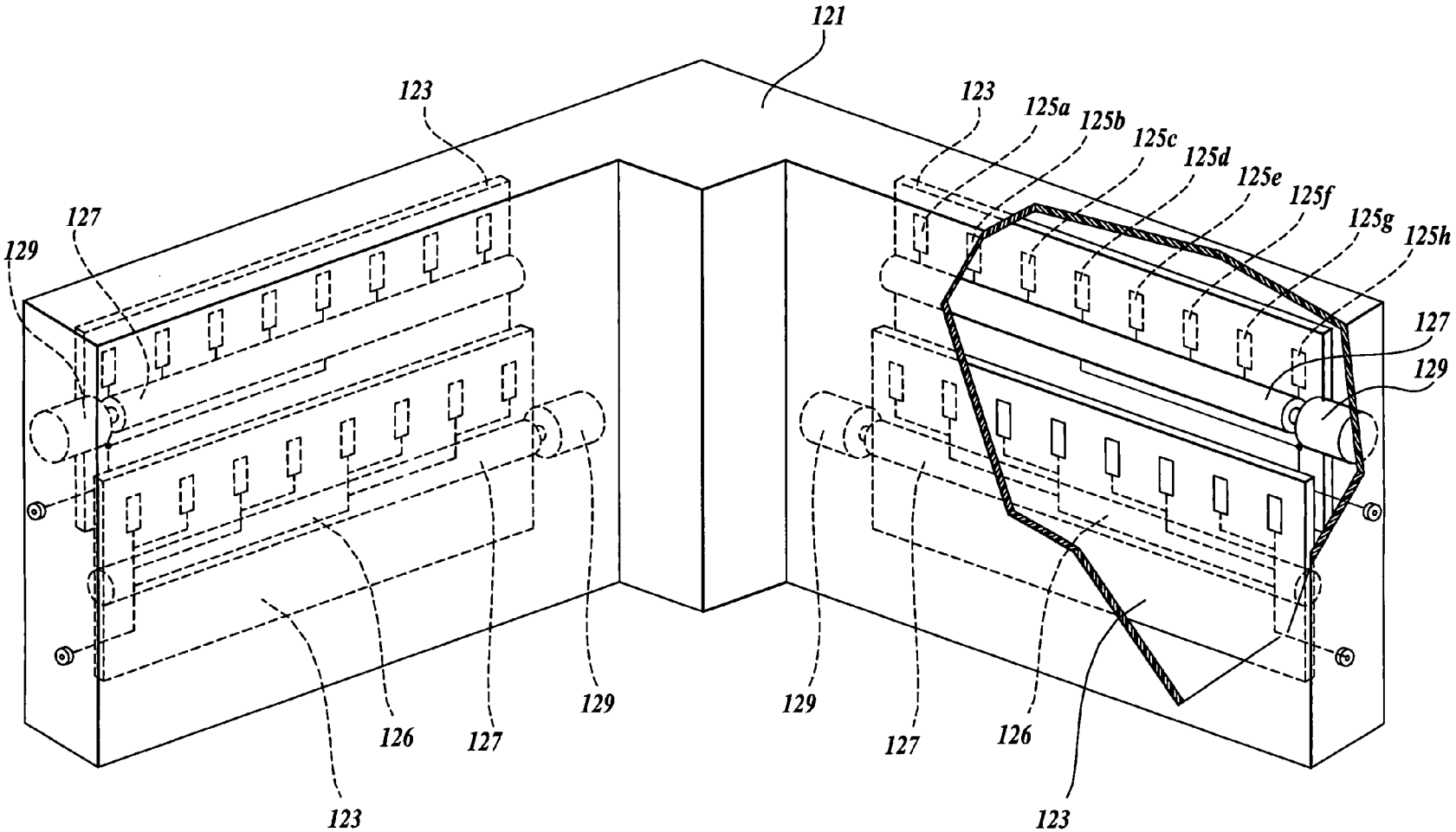
FIG. 13 is an isometric view, partially in section, of a third embodiment of a low-cost, steerable, phased array antenna formed in accordance with the invention.
Figure 14:
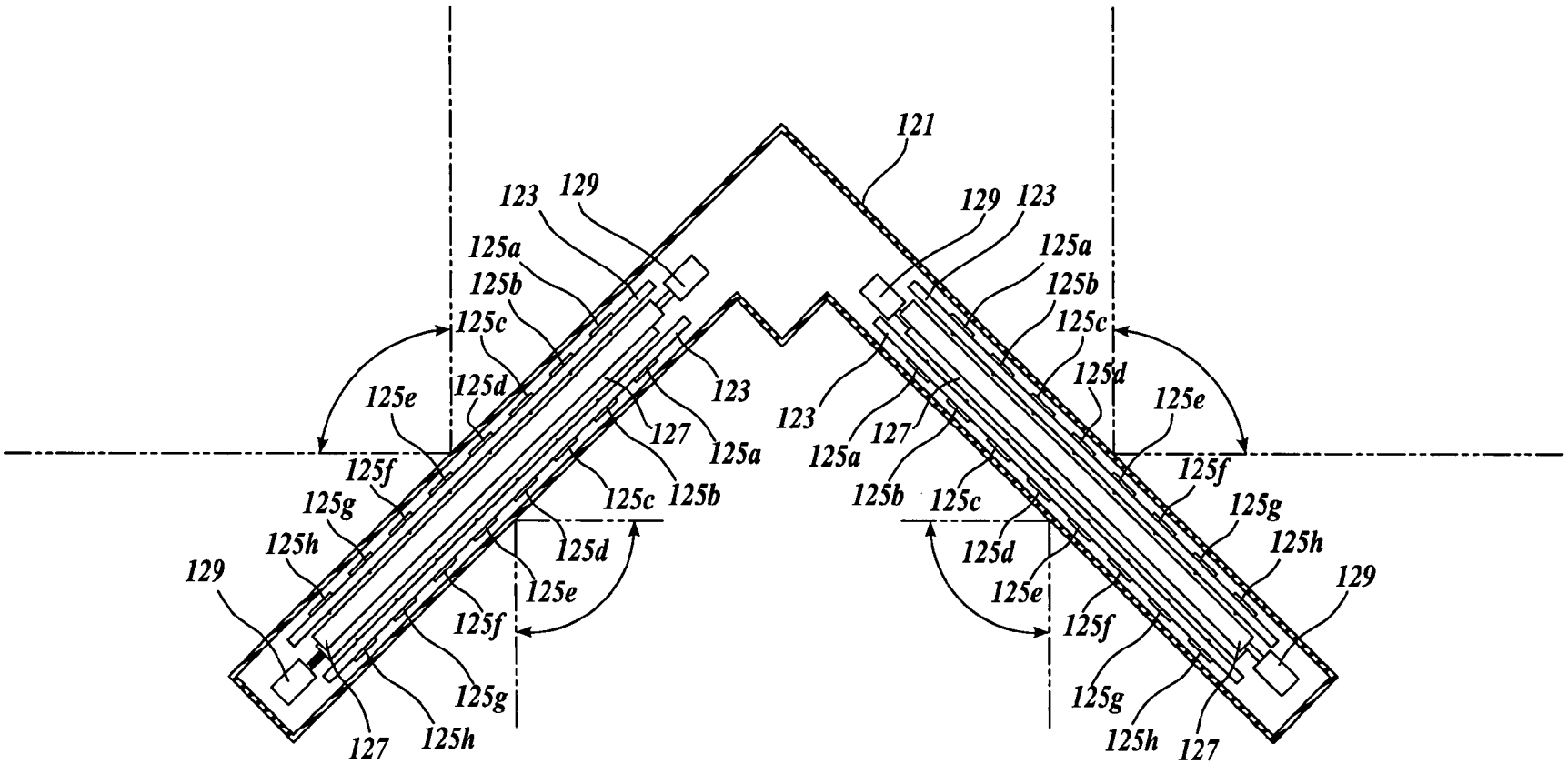
FIG. 14 is a top cross-sectional view of FIG. 13.
Figure 15:
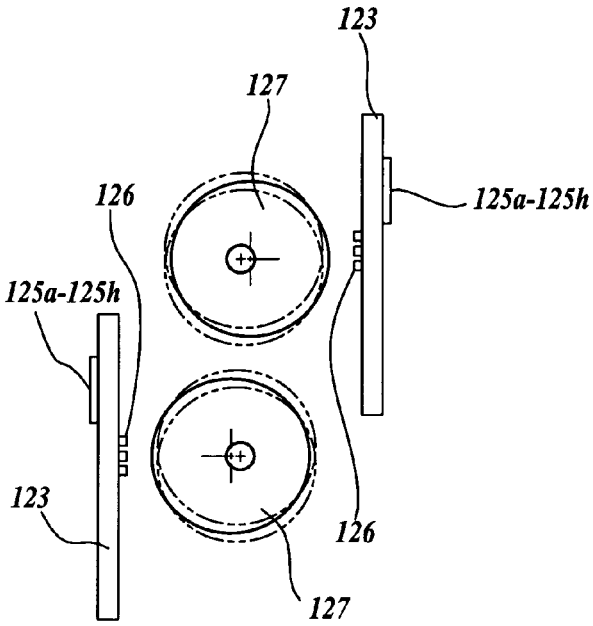
FIG. 15 is an end elevational view of a portion of the phased array antenna illustrated in FIG. 13.

FIGS. 13–15 illustrate a third alternative of a low-cost, steerable, phased array antenna assembly embodying transmission line phase shifters formed in accordance with the invention that, in some ways, is similar to the antenna assembly illustrated in FIGS. 6–8. More specifically, the antenna assembly illustrated in FIGS. 13–15 includes an L-shaped housing 121. Located at each leg of the L-shaped housing 121 are two PCB sheets 123, each supporting the elements and corporate feed of a phased array antenna. One of the sheets in each leg of the L-shaped housing is located adjacent the outer surface of the leg and the other sheet in the same leg is located adjacent the inner surface of the leg. Located on the outer surface of each of the PCB sheets 123 are a plurality of phased array antenna elements 125*a*–*h*. Located on the opposite side of each of the PCB sheets 123 is a corporate feed 126 connected to the antenna elements mounted on the sheet. The corporate feeds 126 are similar to the corporate feed illustrated in FIG. 5 and described above. Overlying each of the corporate feeds 126 is a high-permittivity dielectric cylinder 127, i.e., a cylinder formed of a low-cost, high-permittivity material, such as Rutile, or a Rutile compound containing alkali earth metals, such as Barium or Strontium. Located at one end of each of the high-permittivity dielectric cylinders is a suitable rotation mechanism, such as an electric motor 129. As best illustrated in FIG. 15, the rotational axes of the high-permittivity dielectric cylinders are offset from the rotational axes of their related electric motor 129. As a result, as the motors rotate their respective high-permittivity dielectric cylinders, the air gap between the cylinders and their respective phase shift transmission lines changes to thereby control the time delay or phase shift created by the phase shift transmission lines of the corporate feed in the manner previously described. As with other antenna assemblies, support mechanisms for supporting the PCB sheets, high-permittivity dielectric cylinders, and electric motors are not illustrated in FIGS. 13–15, in order to avoid unduly complicating these figures.

Figure 18:
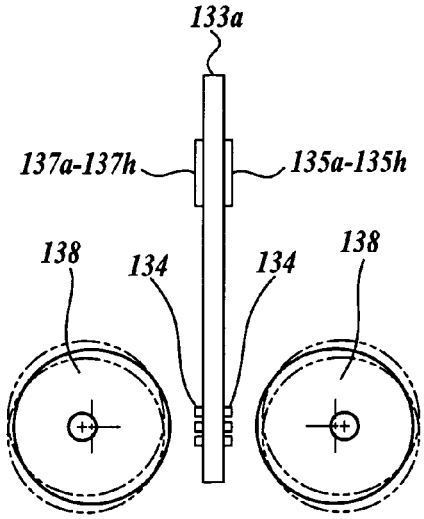
FIG. 18 is an end elevational view of a portion of the phased array antenna illustrated in FIG. 16.
Figure 20:
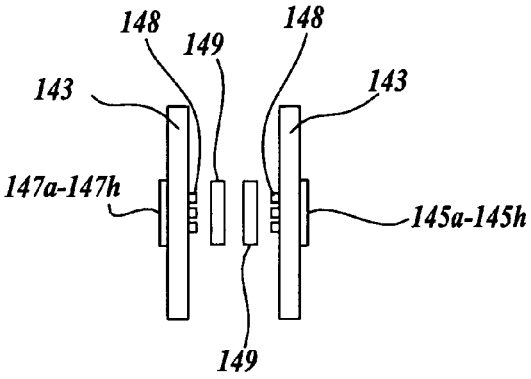
FIG. 20 is an end elevational view of a portion of the phased array antenna illustrated in FIG. 19.
Figure 16:
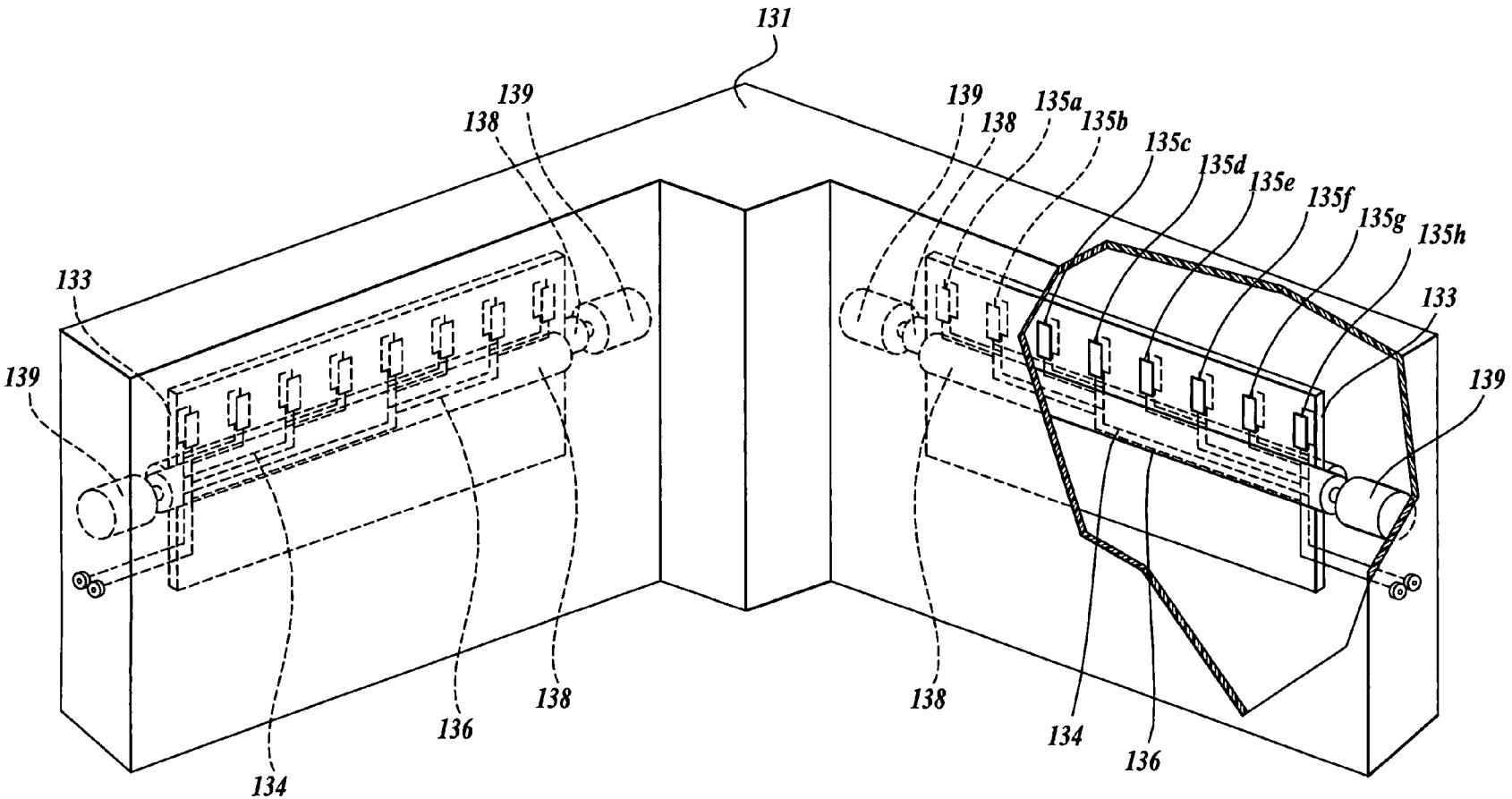
FIG. 16 is an isometric view, partially in section, of a fourth embodiment of a low-cost, steerable, phased array antenna formed in accordance with the invention.
Figure 17:
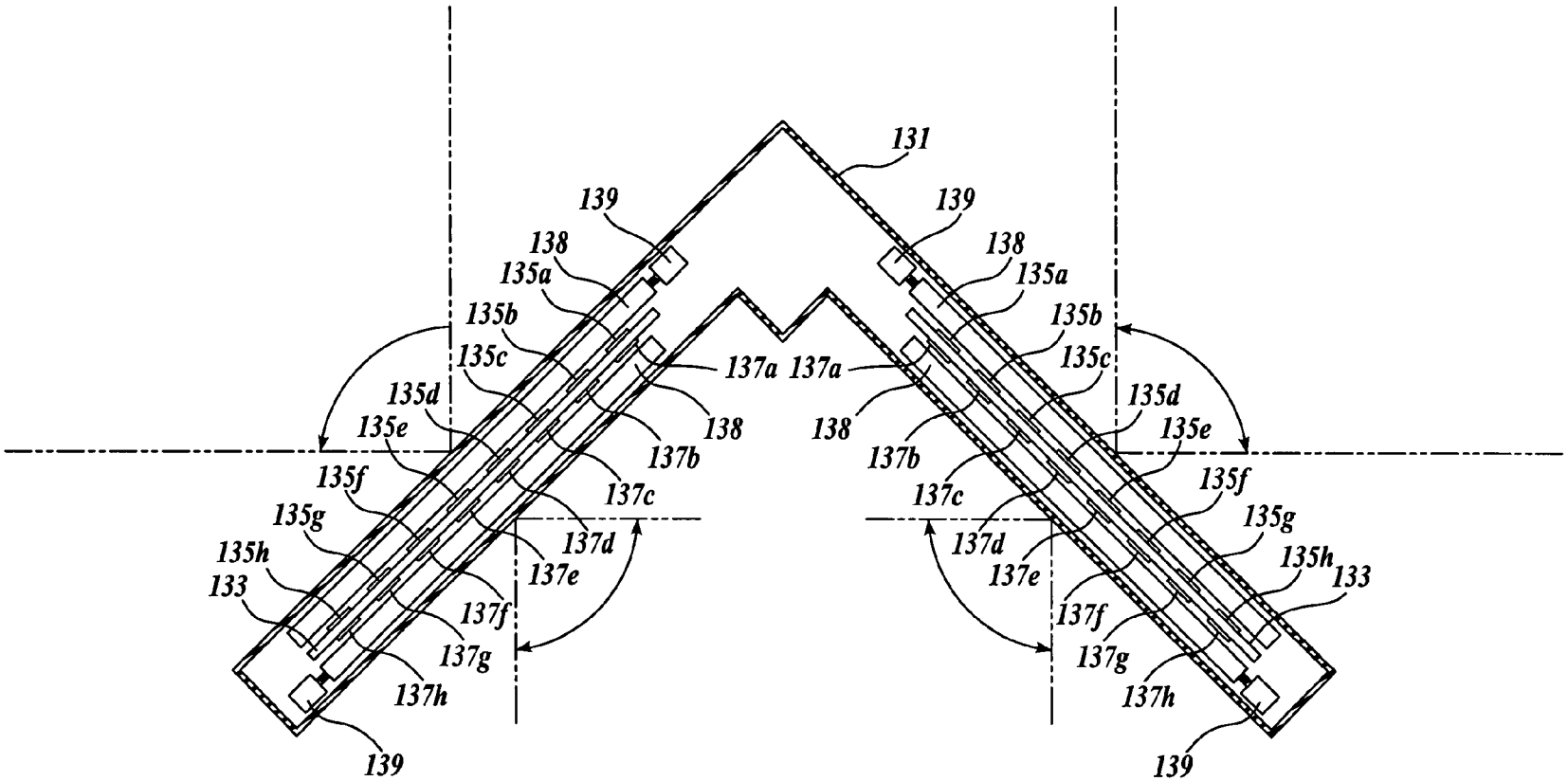
FIG. 17 is a top cross-sectional view of FIG. 16.
Figure 19:
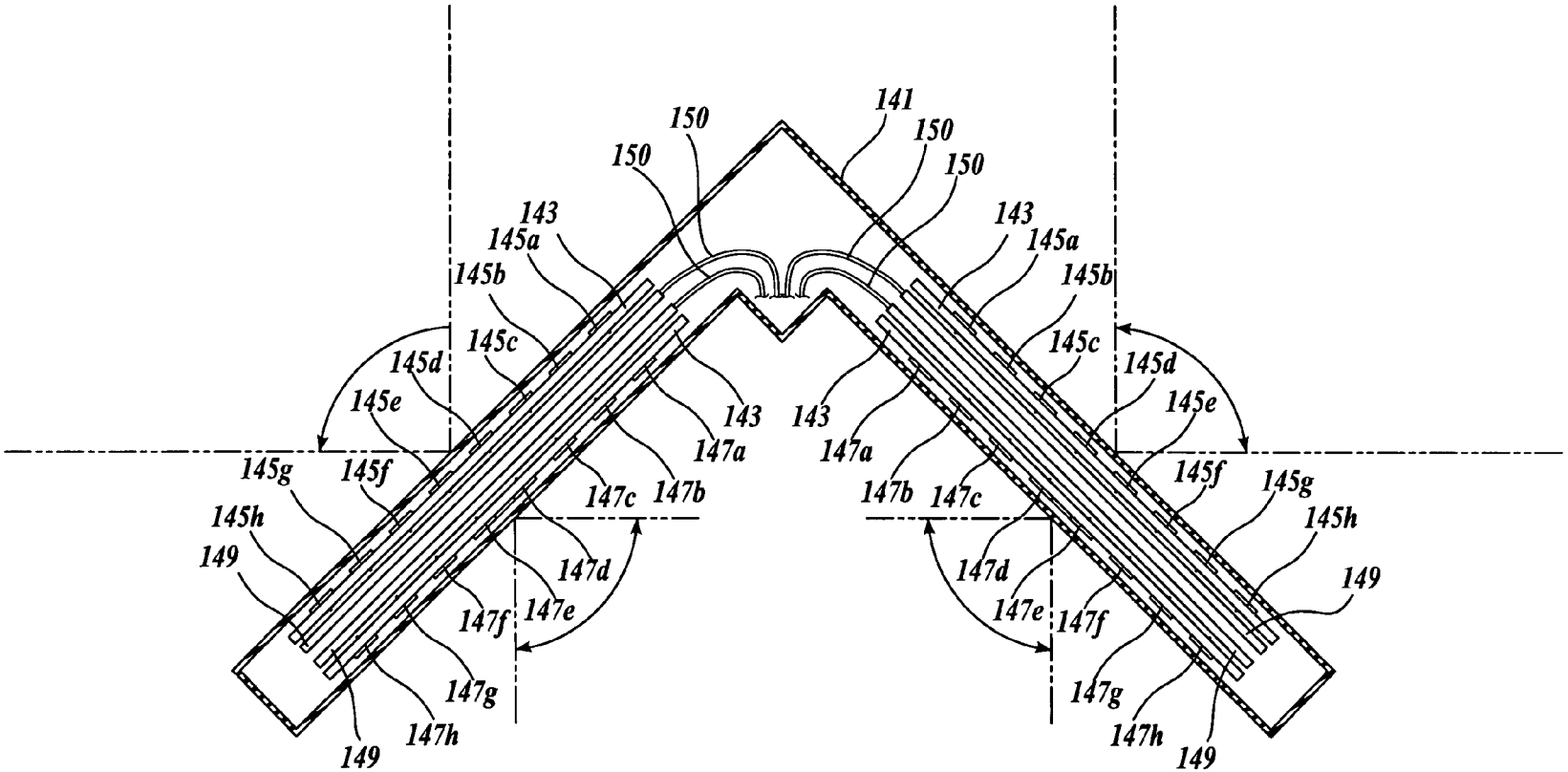
FIG. 19 is a top cross-sectional view of a fifth embodiment of a low-cost, steerable, phased array antenna formed in accordance with the invention.

FIGS. 16–18 illustrate a fourth alternative of a low-cost, steerable, phased array antenna assembly embodying transmission line phase shifters formed in accordance with the invention. The antenna assembly illustrated in FIGS. 16–18, in essence, is a combination of the antenna assembly illustrated in FIGS. 9–11 and FIGS. 13–15. More specifically, the antenna assembly illustrated in FIGS. 16–18 includes an L-shaped housing 131. Mounted in the center of each of the legs of the L-shaped housing 131 is a PCB sheet 133 that supports the elements and corporate feeds of two phased array antennas. More specifically, located on both of the outer faces of each of the PCB sheets 133 is a linear array of antenna elements 135*a*–135*h* and 137*a*–137*h*. Located on both sides of the PCB sheets 133 are corporate feeds for the antenna elements. Mounted outboard of each of the antenna feeds is a high-permittivity dielectric cylinder 138. The high-permittivity dielectric cylinders each overlies a respective corporate feed. Each of the cylinders 138 is rotated by a related rotation mechanism, such as an electric motor 139. As with the embodiment of the invention illustrated in FIGS. 13–15, and as illustrated in FIG. 18, the axis of rotation of each of the high dielectric cylinders is offset from the axis of rotation of its related motor 139. As a result, as the motors rotate their respective cylinders, the air gap between the cylinders and the phase shift transmission lines of their respective corporate feeds change whereby the time delay or phase shift of the phase shift transmission lines of the corporate feed changes in synchronism.

As will be readily appreciated by those skilled in this art and others, the antenna assemblies illustrated in FIGS. 6–18 are based on an electromechanical system for controlling the air gap between a high-permittivity dielectric layer or cylinder and the phase shift transmission lines of a corporate feed. Because the air gap changes in synchronization for all of the corporate feed phase shift transmission lines, the same time delay or phase shift change occurs for each incremental section of the phase shift transmission lines. Because, as illustrated in FIG. 5 and discussed above, individual sections have different lengths related by the factor ½ the delays per phase shift transmission line are mathematically related. Because the incremental amount of change remains constant, the mathematical relationship between the various phase shift transmission lines remains constant, even though the total delay of each phase shift transmission line is different as determined by the length of the individual phase shift transmission lines.

As noted above, the antenna assemblies illustrated in FIGS. 6–18 all depend on electromechanically controlling the air gap between a high-permittivity dielectric layer or cylinder and the phase shift transmission lines of a corporate feed. An alternate to electromechanically varying the air gap is to electrically control the permittivity of a fixed position dielectric layer that overlies the phase shift transmission lines of a corporate feed. It is well known that the permittivity of ferroelectric materials varies under the influence of an electric field. Rutile and compounds of Rutile containing alkali earth metals such as Barium or Strontium exhibit this ferroelectric property. Thin films of such materials have been used to form ferroelectric lenses.

FIGS. 19–22 illustrate alternative low-cost, steerable, phased array antenna assemblies embodying transmission line phase shifters formed in accordance with the invention that employ ferroelectric materials whose permittivity is varied under the influence of an electric field to control the delay time (i.e., phase shift) of the phase shift transmission lines of a corporate feed of the type illustrated in FIG. 5 and employed in a phased array antenna. More specifically, as with other antenna assemblies, the low-cost, steerable, phased array assembly illustrated in FIGS. 19 and 20 includes an L-shaped housing 141. Mounted in each of the legs of the L-shaped housing 141 are two PCB sheets, i.e., two sheets of dielectric material 143. One of the PCB sheets in each of the legs is positioned adjacent to the outer face of the related leg of the L-shaped housing and the other sheet is positioned adjacent the inner face of the leg. The outer facing sides of the PCB sheet each includes a plurality of linearly arrayed antenna elements 145*a*–*h* and 147*a*–147*h*. Thus, as with the FIGS. 6–18 antenna assemblies, the antenna elements of the FIGS. 19–20 antenna assembly point outwardly from the four faces of the legs of the L-shaped housing 141. Mounted on the opposite sides of the PCB sheets 143 from the antenna elements 145*a*–145*h* and 147*a*–147*h*, i.e., on the inwardly facing sides of the PCB sheets are corporate feeds 148 of the type illustrated in FIG. 5 and described above. Overlying each of the corporate feeds 148 is a ferroelectric layer 149, i.e., a layer of material whose permittivity varies under the influence of an electric field. The position of the ferroelectric layers 149 is fixed with respect to the related corporate feed 149. As illustrated by the wires 150, electric power is supplied to the ferroelectric layers 149. Controlling the electric power applied to the ferroelectric layers controls the time delay or phase shift of the phase shift transmission lines of the related corporate feed similar to the way controlling the air gap controls the time delay or phase shift of the phase shift transmission lines of the previously described antenna assemblies.

Figure 22:
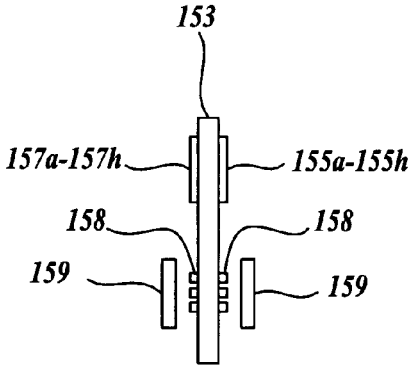
FIG. 22 is an end elevational view of a portion of the phased array antenna illustrated in FIG. 21.
Figure 21:
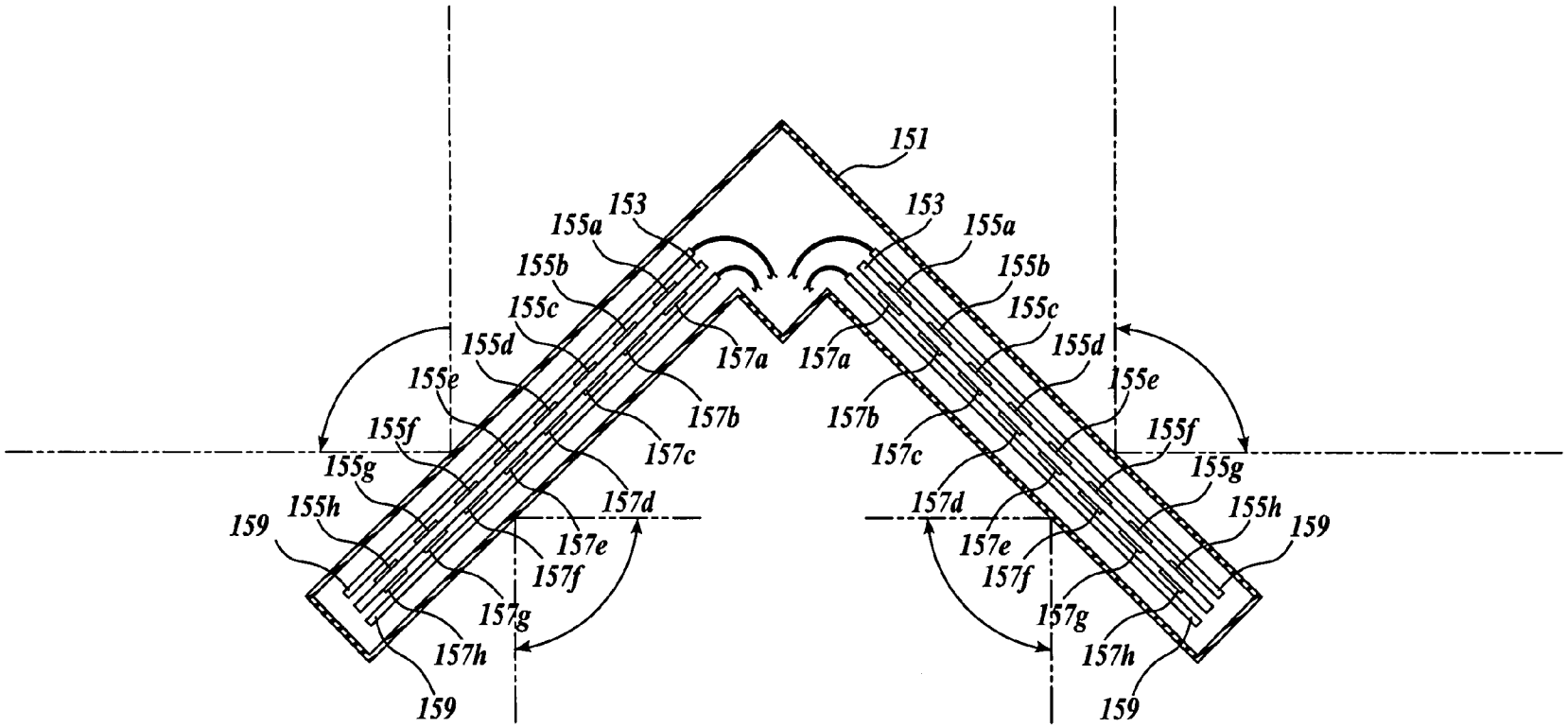
FIG. 21 is a top cross-sectional view of a sixth embodiment of a low-cost, steerable, phased array antenna formed in accordance with the invention.

FIGS. 21 and 22 illustrate a further low-cost, steerable, phased array antenna assembly embodying transmission line phase shifters formed in accordance with the invention that also employs ferroelectric layers to control the phase shift of the phase shift transmission lines of corporate feeds. More specifically, as with the other antenna assemblies, the low-cost, steerable, phased array antenna assembly illustrated in FIGS. 21 and 22 includes an L-shaped housing 151. As with the antenna assemblies illustrated in FIGS. 9–11 and 16–18, located in the center of each leg of the L-shaped housing is a PCB sheet 153. Located on both of the outer surfaces of each of the PCB sheets is a linear array of antennae elements 155*a*–155*h* and 157*a*–157*h*. Also located on both sides of the sheet is a corporate feed 158 of the type illustrated in FIG. 5 and described above. The corporate feeds 158 are connected to the antenna elements located on the same sides of the PCB sheets as the corporate feeds. Overlying each of the corporate feeds is a ferroelectric layer 159, i.e., a layer formed of a ferroelectric material whose permittivity varies under the influence of an electric field. As with the antenna assembly illustrated in FIGS. 19 and 20, varying the electric power applied to the ferroelectric layer controls the time delay or phase shift created by the phase shift transmission lines of the related corporate feed.

Figure 23:
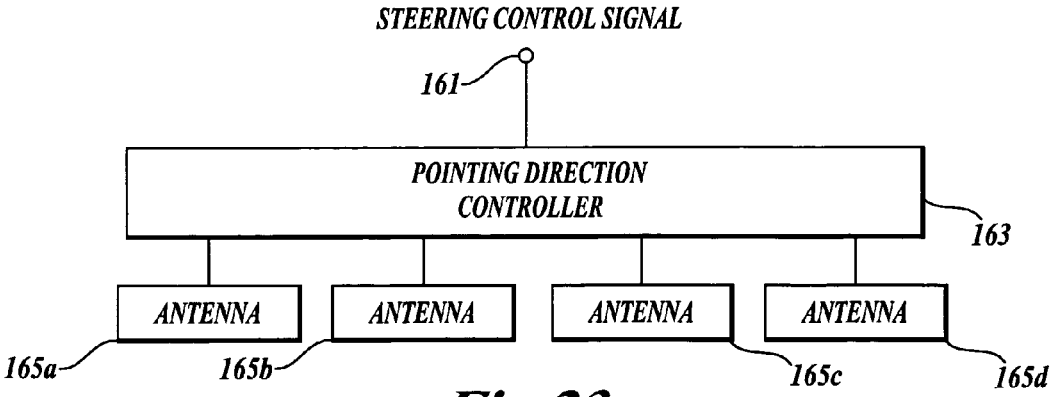
FIG. 23 is a block diagram of a control system for controlling the steering of the embodiments of the invention illustrated in FIGS. 6–22.

FIG. 23 is a block diagram illustrating a control system suitable for controlling the pointing of any of the low-cost, steerable, phased array antennas illustrated in FIGS. 6–22. The control system includes a pointing direction controller shown coupled to four linear phased array antennas 165*a*–165*d* of the type illustrated in FIGS. 6–22 and described above. A steering control signal 161 is applied to the pointing direction controller 163. The steering control signal includes data that defines the antenna pointing direction. The pointing direction controller first decides which of the four linear phased array antennas 165*a*–165*d* covers the quadrant within which the location to be pointed to lies. The pointing direction controller then determines the transmission line phase shift necessary to precisely point at the location. The transmission line phase shift information is used to control the position of the high-permittivity dielectric layers (FIGS. 6–12), the rotation angle of the high-permittivity dielectric cylinders (FIGS. 13–18), or the power applied to the ferroelectric layers (FIGS. 19–22).

Figure 24:
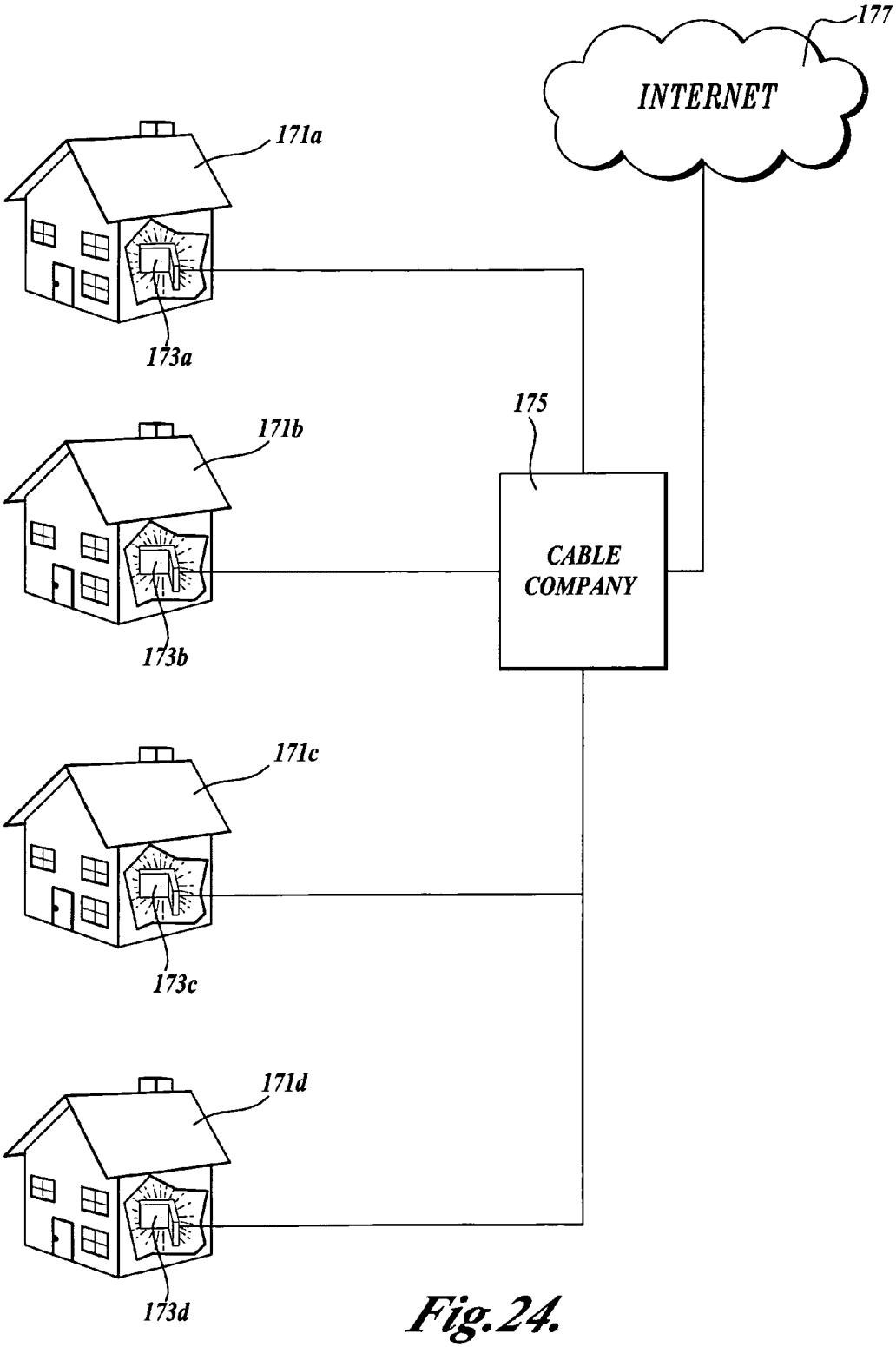
FIG. 24 is a pictorial view of a conventional communication network employing phased array antennas formed in accordance with the invention.
Figure 25:
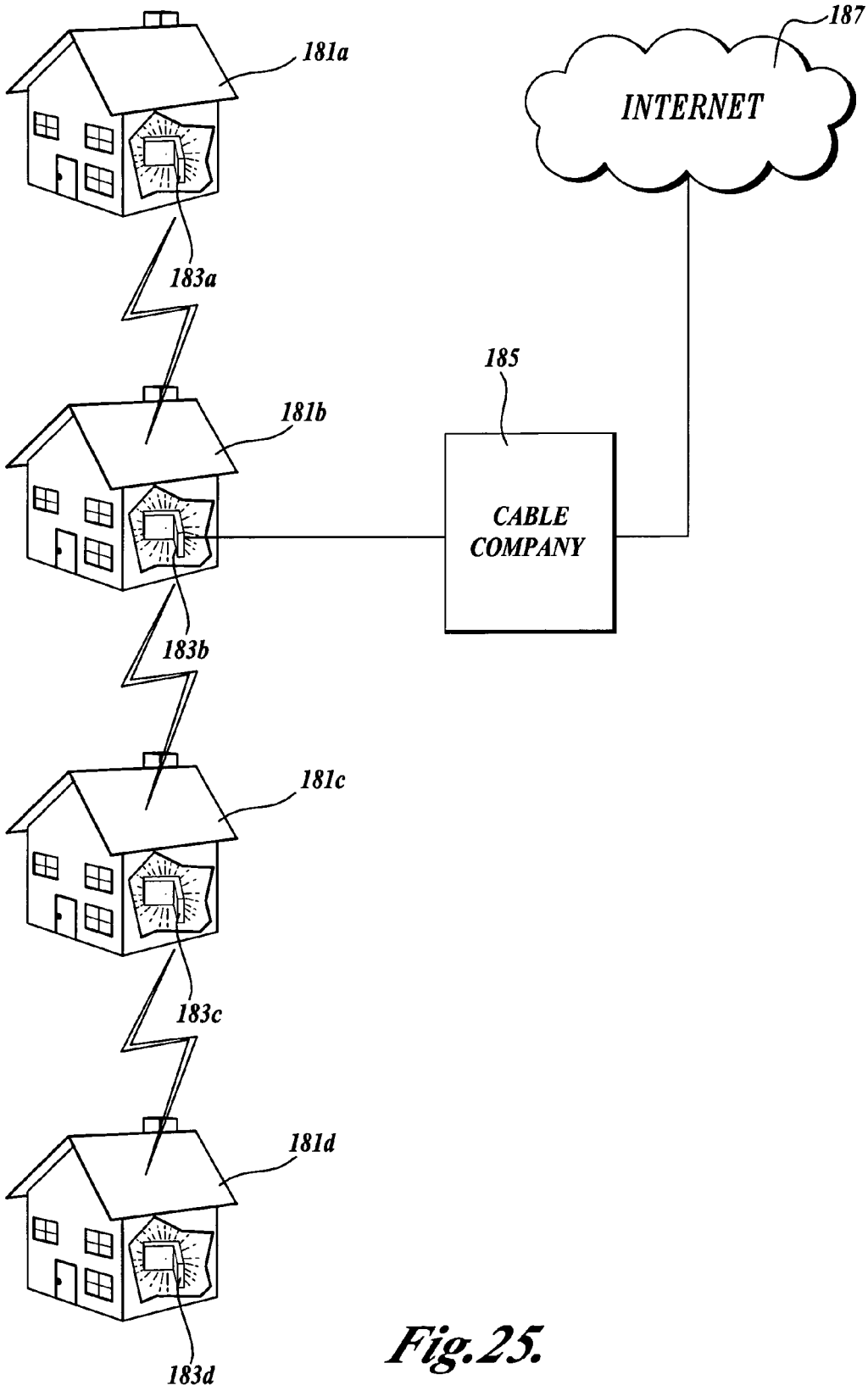
FIG. 25 is a pictorial view of a mesh communication network employing phased array antennas formed in accordance with the invention.

FIGS. 24 and 25 illustrate exemplary uses of low-cost, steerable, phased array antennas. Such antennas can be used in various environments. FIGS. 24 and 25 illustrate the invention used in connection with a WiFi system, included in a house or business residence. More specifically, FIG. 24 illustrates a plurality of residences 171*a*–171*d*, each containing a low-cost, steerable, phased array antenna 173*a*–173*d*. The antennas 173*a*–173*d* are each shown as separately wire connected to an Internet service provider, such as a cable company 175. The service provider, in turn, is shown as connected to the Internet 177.

FIG. 25, like FIG. 24, includes a plurality of residences 181*a*–181*d* each containing a low-cost, steerable, phased array antenna 183*a*–183*d*. However, in contrast to FIG. 24, only one of the residences 181*b* has its antenna 183*b* wire connected to an Internet service provider such as a cable company 185. The Internet service provider is connected to the Internet 187. All of the other residences 181*a*, 181*c*, and 181*d* have their respective antennas 183*a*, 183*c*, and 183*d* coupled in a wireless manner to the antenna 183*b* of the house 181*b* connected to the Internet service provider.

While various antenna assemblies employing transmission line phase shifters formed in accordance with the invention have been illustrated and described, as will be readily appreciated by those skilled in the art and others, transmission line phase shifters may be employed in other environments where low-cost phase shifters are desired. Further, it is to be understood that mechanisms for moving high-permittivity dielectric layers or cylinders other than those specifically disclosed can be employed in other embodiments of the invention. Hence, within the scope of the appended claims it is to be understood that the invention can be practiced otherwise than as specifically described here.

The embodiments of the invention in which an exclusive property or privilege is claimed are defined as follows:

1. A transmission line phase shifter comprising:

a signal conductor;

a high-permittivity dielectric self-supporting layer overlying said signal conductor, said high-permittivity dielectric self-supporting layer including a high-permittivity dielectric material; and a controller for controlling the interaction of the permittivity of the high-permittivity dielectric element with the signal conductor, said controller including an electromechanical system for controlling the position of said high-permittivity dielectric self-supporting layer with respect to said signal conductor by moving said high-permittivity dielectric self-supporting layer toward and away from said signal conductor.

2. A transmission line phase shifter as claimed in claim 1, including a dielectric sheet and wherein said signal conductor is located on a surface of said dielectric sheet.

3. A transmission line phase shifter as claimed in claim 2 wherein said dielectric sheet is a printed circuit board sheet and wherein said signal conductor is created by printing said signal conductor on said printed circuit board.

4. A transmission line phase shifter as claimed in any one of claims 1–3 wherein said high-permittivity dielectric self-supporting layer is formed of a material chosen from the group consisting of Rutile (Titanium Dioxide) and compounds of Rutile containing alkali earth metals.

5. A transmission line phase shifter as claimed in claim 4 wherein said alkali earth metals are chosen from the group consisting of Barium and Strontium.

6. A transmission line phase shifter as claimed in claim 1 wherein said high-permittivity dielectric material includes a plurality of high-permittivity dielectric slugs.

7. A transmission line phase shifter comprising:

a signal conductor;

a high-permittivity dielectric element overlying said signal conductor, said high-permittivity dielectric element is a cylinder that includes a high-permittivity material; and a controller for controlling the interaction of the permittivity of the high-permittivity dielectric element with the signal conductor, said controller including an electromechanical system for controlling the position of said high-permittivity dielectric element with respect to said signal conductor by rotating said cylinder along an axis offset from the axis of said cylinder.

8. A transmission line phase shifter as claimed in claim 7, including a dielectric sheet and wherein said signal conductor is located on a surface of said dielectric sheet.

9. A transmission line phase shifter as claimed in claim 8 wherein said dielectric sheet is a printed circuit board sheet and wherein said signal conductor is created by printing said signal conductor on said printed circuit board.

10. A transmission line phase shifter as claimed in any one of claims 7, 8 and 9 wherein said high-permittivity dielectric element is formed of a material chose from the group consisting of Rutile (Titanium Dioxide) and compounds of Rutile containing alkali earth metals.

11. A transmission line phase shifter as claimed in claim 10 wherein said alkali earth metals are chosen from the group consisting of Barium and Strontium.

12. A transmission line phase shifter as claimed in claim 7 wherein said high-permittivity dielectric material includes a plurality of high-permittivity dielectric slugs.

* * * * *

UNITED STATES PATENT AND TRADEMARK OFFICE

CERTIFICATE OF CORRECTION

PATENT NO. : 7,026,892 B2
APPLICATION NO. : 10/961582
DATED : April 11, 2006
INVENTOR(S) : Kajiya It is certified that error appears in the above-identified patent and that said Letters Patent is hereby corrected as shown below:

In column 3, line 17, delete "using??" and insert -- using --, therefor.

In column 3, line 31, after "drawings" insert -- , --.

In column 6, line 19, delete "alkalite" and insert -- alkaline --, therefor.

In column 7, line 18, after "the" insert -- corporate feed includes an input/output terminal 72 connected to the right-hand side 73a and the left-hand side 73b of the first branches of the corporate feed. The --.

In column 10, line 62–63, delete "113a–112d, 115–115b" and insert -- 113a–113d, 115a–115b --, therefor.

In column 10, line 64, after "sheet" insert -- 111 --.

In column 10, line 66, after "slugs" insert-- 113a, 113b, 113c, --.

In column 11, line 1, delete "substrate 11" and insert -- supporting sheet 111 --, therefor.

In column 11, line 61, after "feeds" insert -- 134, 136 --.

In column 15, line 10, in Claim 10, delete "chose" and insert -- chosen --, therefor.

Signed and Sealed this

Twentieth Day of April, 2010

David J. Kappos

David J. Kappos
*Director of the United States Patent and Trademark Office*